US010207837B2

(12) United States Patent
Zwilling et al.

(10) Patent No.: US 10,207,837 B2
(45) Date of Patent: Feb. 19, 2019

(54) METHOD AND DEVICE FOR LABELING PACKAGES AND CONTAINERS

(71) Applicants: Michael Zwilling, Hamm (DE); Gunnar Clausen, Froendenberg (DE); Klaus Kraemer, Dortmund (DE); Nikolaus Alexander Habers, Overath (DE); Andreas Ullrich, Solingen (DE)

(72) Inventors: Michael Zwilling, Hamm (DE); Gunnar Clausen, Froendenberg (DE); Klaus Kraemer, Dortmund (DE); Nikolaus Alexander Habers, Overath (DE); Andreas Ullrich, Solingen (DE)

(73) Assignee: KHS GmbH, Dortmund (DE)

( * ) Notice: Subject to any disclaimer, the term of this patent is extended or adjusted under 35 U.S.C. 154(b) by 13 days.

(21) Appl. No.: 15/288,179

(22) Filed: Oct. 7, 2016

(65) Prior Publication Data

US 2017/0113828 A1 Apr. 27, 2017

Related U.S. Application Data

(63) Continuation-in-part of application No. PCT/EP2015/055015, filed on Mar. 11, 2015.

(30) Foreign Application Priority Data

Apr. 10, 2014 (DE) ..... 10 2014 105 104

(51) Int. Cl.
*B65C 9/26* (2006.01)
*B65C 9/18* (2006.01)
(Continued)

(52) U.S. Cl.
CPC ..... *B65C 9/26* (2013.01); *B65C 9/12* (2013.01); *B65C 9/1803* (2013.01); *B65C 9/46* (2013.01); *B65C 2009/0018* (2013.01)

(58) Field of Classification Search
CPC ... B65C 9/1803; B65C 9/26; Y10T 156/1062; Y10T 156/1089
See application file for complete search history.

(56) References Cited

U.S. PATENT DOCUMENTS 6,849,147 B2 * 2/2005 Havard ..... B65C 3/16 156/230
2005/0219051 A1 * 10/2005 Nedblake ..... B65C 9/1865 340/572.1
(Continued)

FOREIGN PATENT DOCUMENTS

BR 0 302 257 B1 9/2012
DE 2063483 A1 7/1972
(Continued)

*Primary Examiner* — Mark A Osele
*Assistant Examiner* — Christopher C Caillouet
(74) *Attorney, Agent, or Firm* — Nils H. Ljungman & Associates

(57) ABSTRACT

A method and device for labeling packages and containers. The abstract of the disclosure is submitted herewith as required by 37 C.F.R. § 1.72(b). As stated in 37 C.F.R. § 1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

10 Claims, 9 Drawing Sheets

(51) Int. Cl.

| | |
|---|---|
| ***B65C 9/12*** | (2006.01) |
| ***B65C 9/46*** | (2006.01) |
| *B65C 9/00* | (2006.01) |

(56) References Cited

U.S. PATENT DOCUMENTS

| | | | |
|---|---|---|---|
| 2006/0070700 | A1 | 4/2006 | Cone |
| 2006/0267776 | A1 | 11/2006 | Taki |

FOREIGN PATENT DOCUMENTS

| | | | |
|---|---|---|---|
| DE | 3110187 | C2 | 4/1985 |
| DE | 3715920 | A1 | 11/1988 |
| DE | 4102194 | A1 | 7/1992 |
| DE | 202010004060 | U1 | 6/2010 |
| DE | 102010019855 | A1 | 11/2011 |
| ES | 2020709 | A6 | 9/1991 |
| JP | 2597330 | B2 | 4/1997 |
| JP | 2003211566 | A | 7/2003 |
| JP | 2003237748 | A | 8/2003 |
| JP | 2006027641 | A | 2/2006 |
| JP | 2009062008 | A | 3/2009 |
| WO | WO 0181179 | A1 | 11/2001 |

* cited by examiner

METHOD AND DEVICE FOR LABELING PACKAGES AND CONTAINERS

CONTINUING APPLICATION DATA

This application is a Continuation-In-Part application of International Patent Application No. PCT/EP2015/055015, filed on Mar. 11, 2015, which claims priority from Federal Republic of Germany Patent Application No. 10 2014 105 104.1, filed on Apr. 10, 2014. International Patent Application No. PCT/EP2015/055015 was pending as of the filing date of this application. The United States was an elected state in International Patent Application No. PCT/EP2015/055015.

BACKGROUND

1. Technical Field:

The present application relates to a method and device for labeling packages and containers.

2. Background Information:

Background information is for informational purposes only and does not necessarily admit that subsequently mentioned information and publications are prior art.

The present application relates to a method of a labeling system, for example in the form of a labeling apparatus according to the present application, and to a device or labeling machine according to the present application.

In practice, it often occurs that a packaging means, for example, a container or other packaging, is first labeled with a label element, and then it becomes necessary or desirable to have an additional label element applied onto the packaging means in the form of an additional label. This is the case, for example, if internationally operating beverage filling concerns make use of one and the same base label in the countries in which they are active, but in individual countries or for individual countries the packaging means must or should be provided with additional country-specific information, for example, with information not present on the base label regarding the composition of the product, in the respective national language. Other reasons for such individualization are, for example, different regulations which apply for identification marking in different countries, and/or different language versions. By the application of the additional label, the logistics of the supply chain are simplified, since the base label can remain unchanged, and the packaging means specified for export are provided with necessary and/or desired additional and/or alternative information by making use of the additional label(s).

According to the methods usually employed hitherto, the application of the base labels and then the application of the additional labels takes place with separate labeling devices. Usually a first labeling device applies the base labels onto the not yet labeled packaging means, and then, with a second labeling device, the additional labels are applied onto the base labels already provided on the packaging means. In this situation, however, it is very difficult if not impossible to achieve an exact or substantially exact positioning or location of the additional labels with respect to the base label, or with respect to design features provided there. Some design features are graphics, pictures, lines, edges, borders, decorative features, text, embossments, raised lettering, or other parts of the base label, which design features can be used as a reference point for the application and positioning of additional labels. As a result, the required and/or desired visual quality of the entire arrangement (base label plus additional label) cannot be maintained, and more specifically such inaccurate positioning can be due to tolerances in the centering of the packaging means during the labeling and/or by tolerances in the diameter of the packaging means.

There are different methods and different labeling systems for producing multi-layered or multiple labels, comprising in each case a base label and an additional label element applied onto the front side of this base label, as well as for the labeling of packaging means with such multiple labels. These methods and devices have in common the fact that, for the base labels, self-adhering labels are used that are already spaced apart from one another on a carrier strip, onto which an additional, likewise self-adhering label element is applied before application onto the packaging means. In order to transfer the multiple label onto the packaging means, the carrier strip is moved over a dispensing edge, which detaches the multiple label.

Other methods and labeling systems involve separating labels from a self-adhering web or strip-form label material arranged on a carrier material, which labels are formed in each case from a part length or portion of this label material. After the separation, radio frequency identification (RFID) chips are applied onto the self-adhesive rear side of the labels. Consequently, after the application of the respective label onto a packaging means, the RFID chips are arranged under the labels such that they cannot be seen.

In another method and labeling system, part lengths or portions are cut from a web or strip-form label material to form base labels. These portions are then held on a transfer drum and conveyed past a dispensing edge, at which the application of an additional self-adhering label element onto the front side of the base labels takes place.

In yet another method and labeling system, individual sheet labels are processed or handled with circulating label pallets provided on a pallet carrier. Each of the label pallets has adhesive applied to it. For the simultaneous or substantially simultaneous application of a strip label, a top-part label, and a bottom-part label onto the respective packaging means, such as a bottle, first the strip label is drawn from a suitable label store, and then the top-part label and the bottom-part label. In order to connect the strip label to the top-part label and the bottom-part label, additional adhesive applications are required to be applied onto the front side of the strip label facing away from the label pallets, which incurs additional effort, at least in terms of design but also with regard to control technology.

OBJECT OR OBJECTS

An object of the present application is to provide a method which allows for an exactly or substantially exactly correct positional and/or locational arrangement of the additional label elements onto the base label.

SUMMARY

To achieve this object, the present application discloses a labeling method, a labeling system, such as a labeling apparatus, and a device for the provision of packaging means.

The present application is based on the recognition that, inside the labeling system or the labeling apparatus, the respective position of the base labels and of the additional label elements to be applied onto them is exactly or substantially exactly defined and/or is adjustable. It is therefore possible, with minimal difficulty, inside the labeling system or the labeling apparatus, for the respective additional label element to be applied with high precision in a precise or substantially precise location on the respective base label. The additional label element is, for example, a flat element in the form of an additional label, but it can also be an element configured, in at least one possible exemplification, as substantially flat but with three-dimensional or raised features, for example, in the form of a three-dimensional stick-on label or attachment.

The labeling system according to the present application comprises at least two labeling units or stations, which are combined to form one work station of a device for equipping or labeling of packaging means. At least one of the labeling units or stations serves to apply the additional label elements onto or to the base labels inside the work station, and a labeling unit or station for applying the base labels, provided with the additional label elements, onto the packaging means. With one possible exemplification, the labeling system is a labeling apparatus in the form of a labeling unit or station for applying the base labels, provided with the additional label elements, onto the packaging means, wherein the at least one labeling unit or station for applying the additional label elements onto or to the base labels is integrated into this labeling apparatus.

"Packaging means" in the meaning of the present application refers to many different kinds of packages or containers, such as, but not limited to, food packages or containers, beverage packages or containers including bottles and cans, packages or containers made from glass, plastic, cardboard, paper, metal, aluminum, PET, and other materials, and transport containers such as bottle crates.

The term "roll-fed labels" is to be understood in the meaning of the present application such that the web or strip-form label material, provided as a storage roll, is drawn off and separated. In one possible exemplification, these labels, after the transfer of their leading label end to a packaging means, such as containers, are then applied onto the packaging means by rolling, for which purpose the packaging means are rotated at high speed about a packaging means axis, such as the vertical packaging means axis. In this situation, the respective roll-fed label is provided with application of an adhesive, at least at its leading label end and its trailing label end at the transfer, but it may also be configured as self-adhesive.

The expression "essentially" or "approximately" or "approx." in the meaning of the present application signifies deviations from the exact or substantially exact value in each case by +/−10%, in one possible exemplification by +/−5%, and/or deviations in the form of changes which are not of significance to the function.

The application of the respective additional label element takes place with the use of a labeling unit or station, which is integrated into a labeling system, for example into a labeling apparatus, for the application of the base labels, for example into a labeling system or into a labeling apparatus for processing a web or strip-form labeling material, or into a labeling system or into a labeling apparatus for the processing of single-sheet labels.

According to the present application, the method of applying labels is adjustable to allow the use of different types of labels. In one possible exemplification, additional label elements may be single-sheet label elements or label elements separated or detached from a web or strip-form material. In another possible exemplification, additional label elements may be self-adhesive label elements, for example label elements which are self-adhesive on both sides. In another possible exemplification, additional label elements may be labels that are connected by means of an adhesive or glue application to the respective base label, wherein the glue application takes place directly before this connection. In another possible exemplification, additional label elements may be applied onto the base label held on a label carrier, e.g. on a label pallet of the labeling system or of the labeling apparatus. In another possible exemplification, the application of additional label elements may be controlled by a sensor system, which monitors the location and/or position of the base label or of the label material. In another possible exemplification, the connection of the additional label elements to the base labels takes place by welding, such as by laser or ultrasonic welding. It should be understood that the each of the preceding features or exemplifications can be used individually or in any desired combination in accordance with at least one possible exemplification.

In a further exemplification of the present application, the labeling system and/or the labeling apparatus are configured, for example, such that a sensor system is provided for the recognition of the respective present location and/or position of the respective base label, and/or for controlling a precise or substantially precise locational and/or positional application of the at least one additional label element to the base label. In another possible exemplification, the at least one further labeling unit or station is configured for the processing of single-sheet label elements, or for the processing of label elements prepared from a web or strip-form label material. In another possible exemplification, means are provided for the application of an adhesive for the connection of the respective additional label element to the base label, wherein these means are formed, for example, by at least one glue nozzle, for example by a glue nozzle for hot glues, by a glue roller, or by a glue punch. It should be understood that the each of the preceding features or exemplifications can be used individually or in any desired combination in accordance with at least one possible exemplification.

Further exemplifications and possible applications of the present application are also derived from the following description of exemplary exemplifications and from the figures. In this context, the features described and/or pictorially represented are in principle an object of the present application, individually or in any desired combination, regardless of their relationship in reference to them.

The above-discussed exemplifications of the present invention will be described further herein below. When the word "invention" or "exemplification of the invention" is used in this specification, the word "invention" or "exemplification of the invention" includes "inventions" or "exemplifications of the invention", that is the plural of "invention" or "exemplification of the invention". By stating "invention" or "exemplification of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail hereinafter in connection with the figures, and also by way of exemplary exemplifications. The figures show.

DESCRIPTION OF EXEMPLIFICATION OR EXEMPLIFICATIONS

Figure 1:
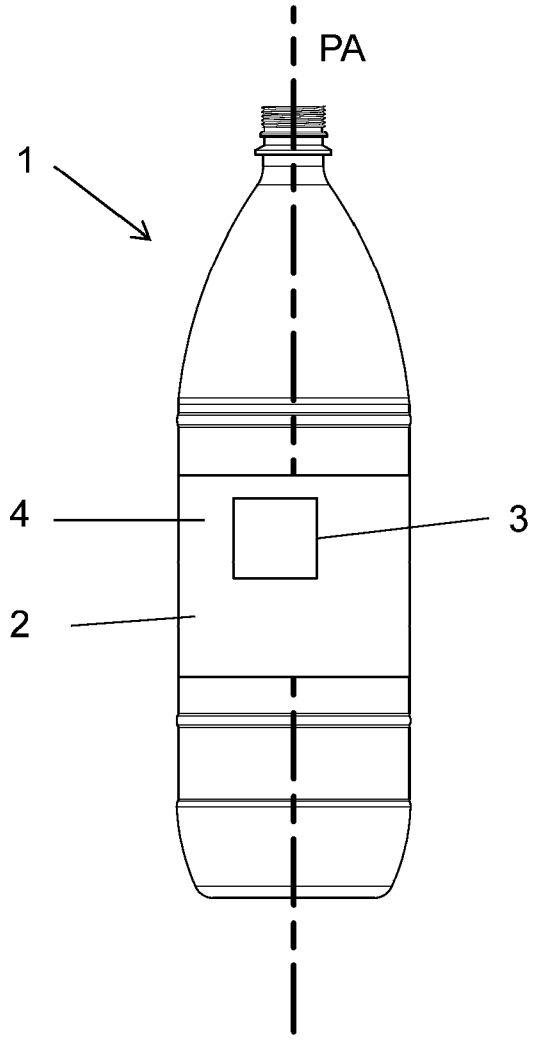
FIG. 1 shows a side view of a packaging means in the form of a bottle, provided with a base label and with an additional label element arranged on this base label, in the form of an additional label.

In the figures, 1 is a packaging means in the form of a container or a bottle, such as a PET bottle. The packaging means 1 is provided with a base label 2 and with an additional label 3, which is applied in a predetermined orientation and location onto the front side of the base label 2, which faces away from the packaging means and is therefore visible, and specifically in a specified orientation and location relative to at least one design feature of the base label 2. The design feature is indicated in FIG. 1 schematically by the broken line 4, and is formed, for example, by a graphic and/or pictorial constituent part or by an edge or border, or other such part, of the base label 2.

Figure 2:
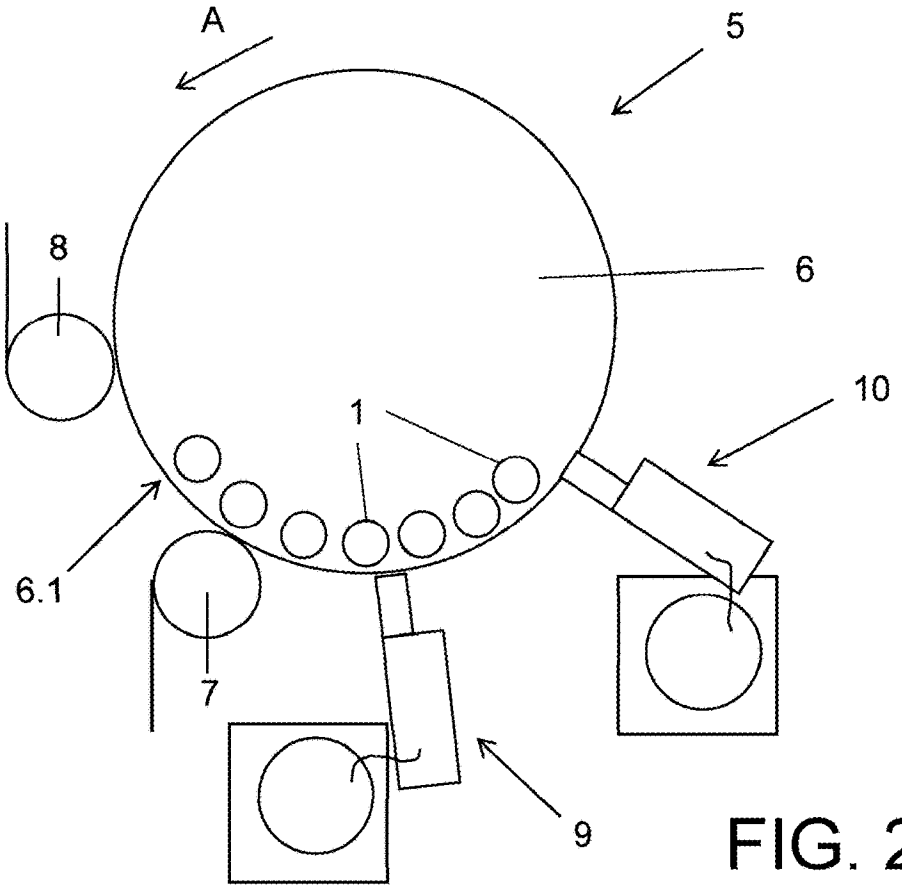
FIG. 2 Prior Art
FIG. 2 shows a schematic representation, as viewed from above, of a labeling machine having a circulating design, for the equipping of packaging means with, in each case, a base label and an additional label, according to the prior art.

FIG. 2 shows a schematic representation, as viewed from above, of a labeling machine 5 of a circulating or rotary design, as used hitherto for the equipping of containers or bottles with the base label 2 and with the additional label element 3. This known labeling machine 5 comprises a rotor 6 which can be driven such as to rotate in a direction A about a vertical machine axis, arranged at the circumference or perimeter of which are a plurality of handling positions 6.1 for accommodating, in each case, a packaging means 1. The packaging means 1 to be labeled are conveyed to the handling means 6.1, in each case, individually by means of a packaging means inlet 7. The packaging means 1 provided with the base label 2 and the additional label element 3 are removed from the treatment positions 6.1 at a packaging means outlet 8. The packaging means 1, oriented with their packaging means axis PA in a vertical direction, are next moved by the rotor 6 to a labeling apparatus 9 for the application of the respective base label 2, and then to a further labeling apparatus 10 for the application of the respective additional label element 3 onto the respective base label 2, already present on the packaging means 1. It may not be possible with this method to reach the precise or substantially precise location and/or position of the additional label element 3 on the base label 2. This is caused by, among other things, tolerances in the centering of the packaging means 1 at the treatment positions 6.1, but also, in one possible exemplification, with the formation of the base labels 2 as what are referred to as "roll-fed label", due to tolerances in the diameter of the packaging means 1.

Figure 3:
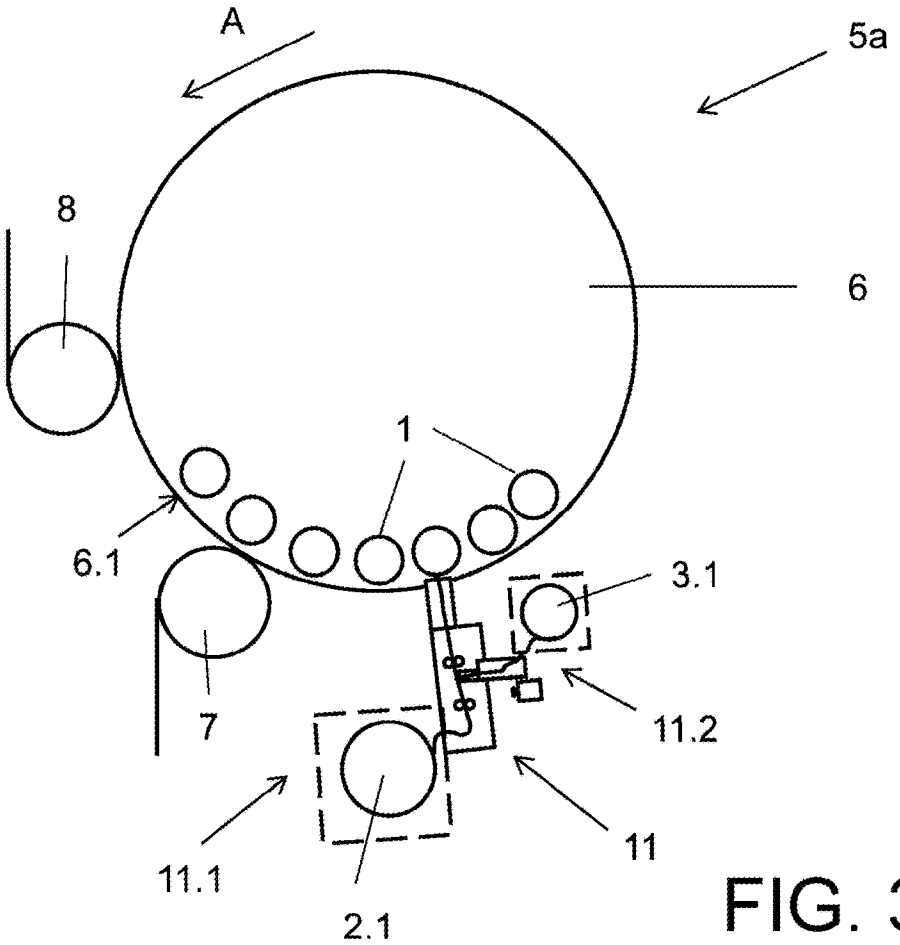
FIG. 3 shows a schematic representation, as viewed from above, of a labeling machine according to the present application for the equipping of packaging means with, in each case, a base label and an additional label.
Figure 4:
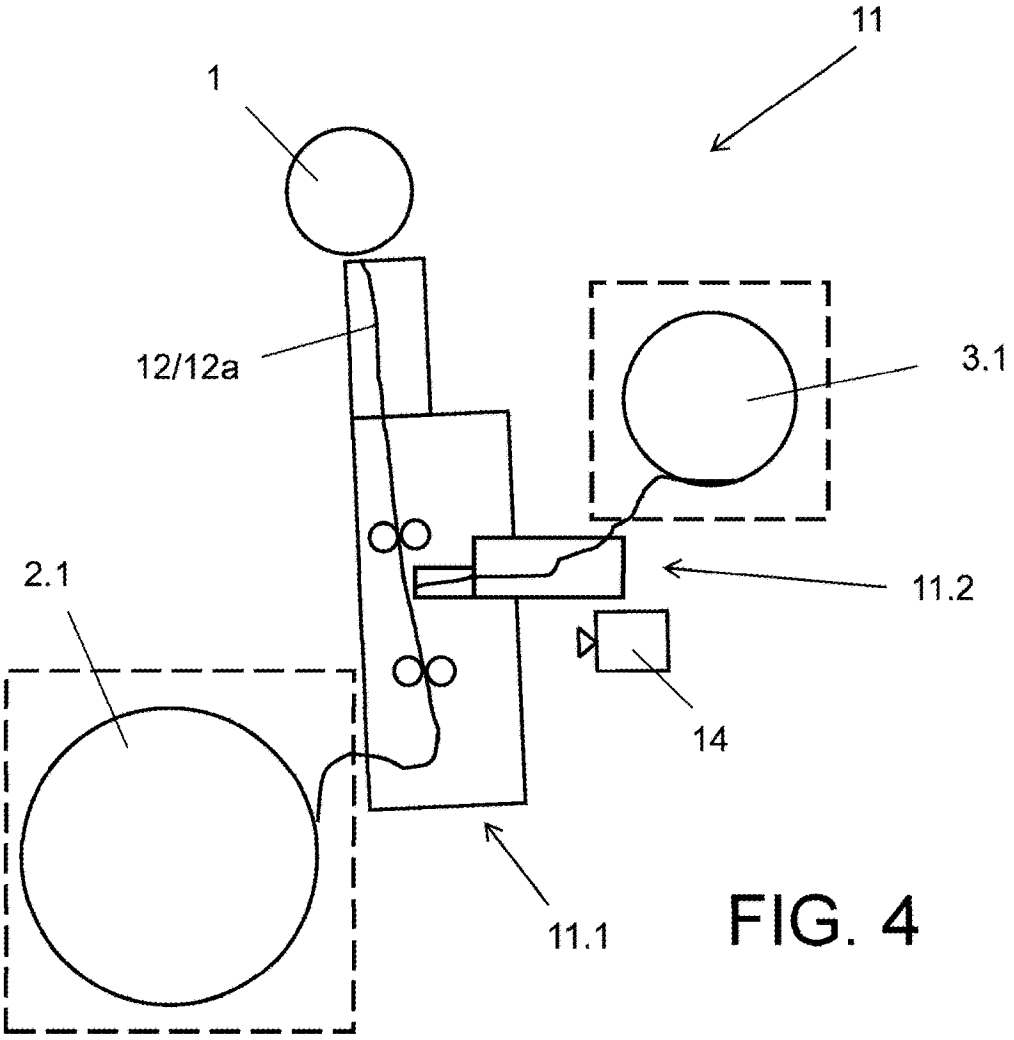
FIG. 4 shows a schematic representation, as viewed from above, of a labeling machine in the form of a labeling apparatus of the labeling machine from FIG. 3.
Figure 5:
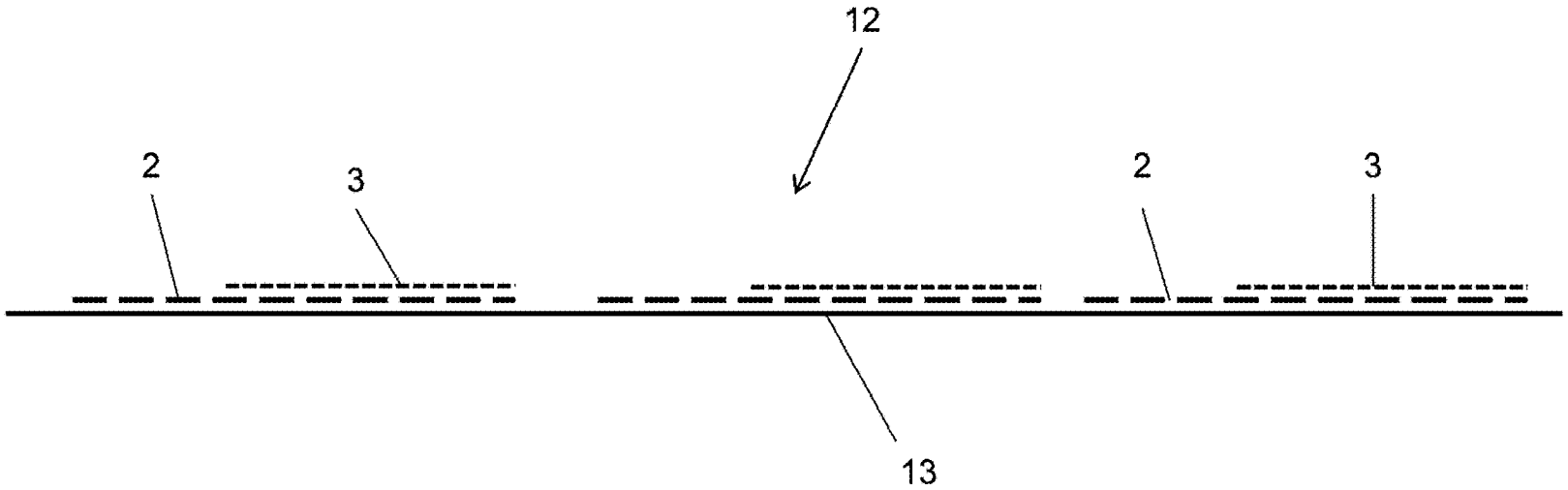
FIG. 5 shows a simplified sectional representation of a part length of a web or strip-form label material, as used with an exemplification of the method according to the present application.

FIGS. 3 through 5 show in schematic representation and in a view from above, a labeling machine 5*a* according to the present application, with a labeling apparatus 11 and a web or strip-form label material 12 for use with an exemplification of the method according to the present application, which avoids, restricts, and/or minimizes the disadvantages of other labeling machines. The labeling machine 5*a* comprises a rotor 6 that circulates about a vertical machine axis. The labeling machine 5*a* comprises packaging means treatment positions 6.1, that are disposed about the periphery or circumference of the rotor 6, and are distributed at equal angular distances about the machine axis. The packaging means 1 to be labeled are conveyed via the packaging means inlet 7 to the rotor 6, and individually conveyed into the packaging means treatment positions 6.1. The packaging means 1, after being labeled with the base label 2 and provided with the additional label element 3, are removed at the packaging means outlet 8.

The labeling apparatus 11, in the exemplification shown, is a combination of a first labeling station 11.1, in the form of a roll-fed labeling station, that is, a labeling station for the processing of roll-fed labels, and a second labeling station 11.2, in the form of a station for the application of, for example, self-adhesive labels, which form the respective additional label element 3.

The label material forming the base labels 2 is drawn off as a web from a store or from a label roll 2.1, and, before the application of the respective base label 2 onto a packaging means 1 inside the labeling apparatus 11, is conveyed past the labeling station 11.2. At the labeling station 11.2, the additional label elements 3, for example, self-adhesive label elements, are applied onto the web or strip-form label material forming the base labels 2. Consequently, after passing the labeling station 11.2, the label material is in the form of label material 12, as shown in FIG. 5, in which each base label 2 is provided on its front side with an additional label element 3 in the form of an additional label (supplementary label).

The labeling apparatus 11 is configured for the processing of roll-fed labels in the form of non-self-adhesive base labels 2, which are produced by drawing off and separating from a web or strip-form label material. The respective base label 2 is provided with at least one glue application on its label end which is leading at the transfer to a packaging means 1. The respective base label 2 is applied onto the packaging means 1 by rolling, and is fixed by its trailing end at the transfer to a packaging means 1 by a further application of glue.

By the integration of the labeling station 11.2 into the labeling station 11.1, that is, by the application of the additional label elements 3 onto the base labels 2, and, respectively, due to the fact that the web or strip-shaped label material 12 forms the base labels 2, a high degree of precision can be achieved with regard to the exact or substantially exact location and/or position of the additional label elements. The application of the additional label elements 3 is controlled by suitable measures or by a suitable sensor system 14, for example by a camera and image processing system and/or by sensors, and specifically, for example, by taking account and/or detection of striking features of the base labels 2 or of the web or strip-form label material 12 forming these labels, for example by detection of printing marks, which are provided on the base labels 2 or on the label material 12. With the sensor system 14, the alignment and/or positioning of the respective base label 2 at any moment is detected, such that the additional label element 3 is then applied with exact or substantially exact position and/or location onto the base label 2 concerned.

Figure 7:
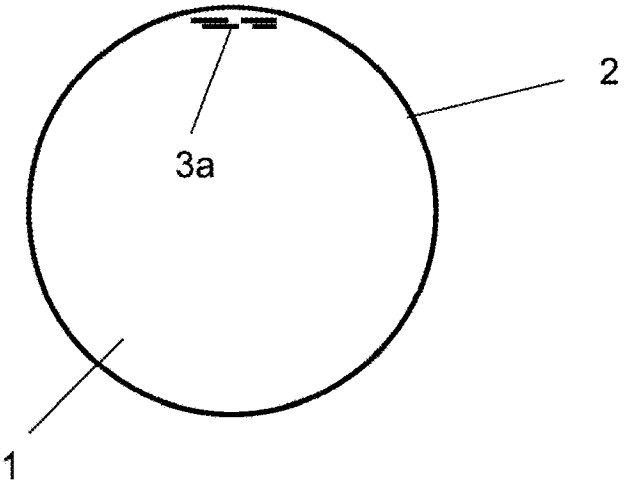
FIG. 7 shows a schematic representation of the label from FIG. 6, completely surrounding a packaging means, for example in the form of a bottle, in the form of a banderole at a circular cylindrical packaging means region.
Figure 6:
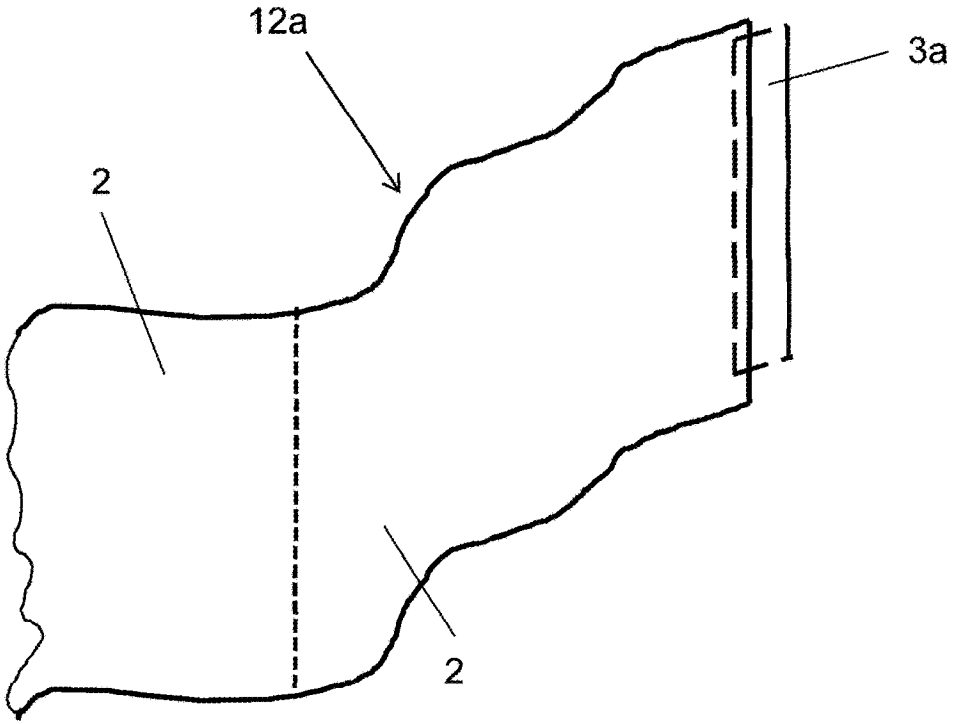
FIG. 6 shows a base label, provided with an additional label element in the form of an adhesive strip.

It has been assumed heretofore that, with the labeling station 11.2 of the labeling apparatus 11, the additional label elements 3 forming the additional labels or equipment elements are applied onto the front side of the base label 2 or of the web or strip-form label material forming these labels. FIG. 6 shows a web-form label material 12*a* forming the base labels 2 (roll-fed labels). Before the transfer in each case of the base label 2, separated from the label material 12*a*, each label 2 is provided on its rear side, at its leading end at the time of transfer, with an additional label element 3*a* in the form of an adhesive strip, self-adhesive on both sides. The application of the additional label elements 3*a* is effected in turn inside the labeling apparatus 11 with the labeling station 11.2, and specifically controlled by the sensor system 14. With the additional label elements 3*a*, which are provided on the rear side of the respective base label 2, which is not visible after the labeling, the fixing takes place, at the transfer of the label to the packaging means 1, of the respective base label 2 to the packaging means 1, as well as, after the complete rolling of the base label 2 on the packaging means 1, also the fixing of the trailing end of the label. The respective additional label element 3*a* overlaps for this purpose the joint between the two label ends, as is made clear in FIG. 7.

With this exemplification it is further possible, at the transfer, for an additional label element 3*a* to be provided to the trailing end of each base label 2. The use of the label elements 3*a*, in one possible exemplification, also has the advantage that the provision of glue for the fixing of the leading and trailing ends of the label can be done without. As a result, dirt contamination that is necessarily or usually incurred by the use of glue, is avoided, restricted, and/or minimized. The effort and expenditure of cleaning and maintenance is thereby reduced, and likewise sources of risk due to hot glue and hot surfaces are avoided, restricted, and/or minimized.

Figure 8:
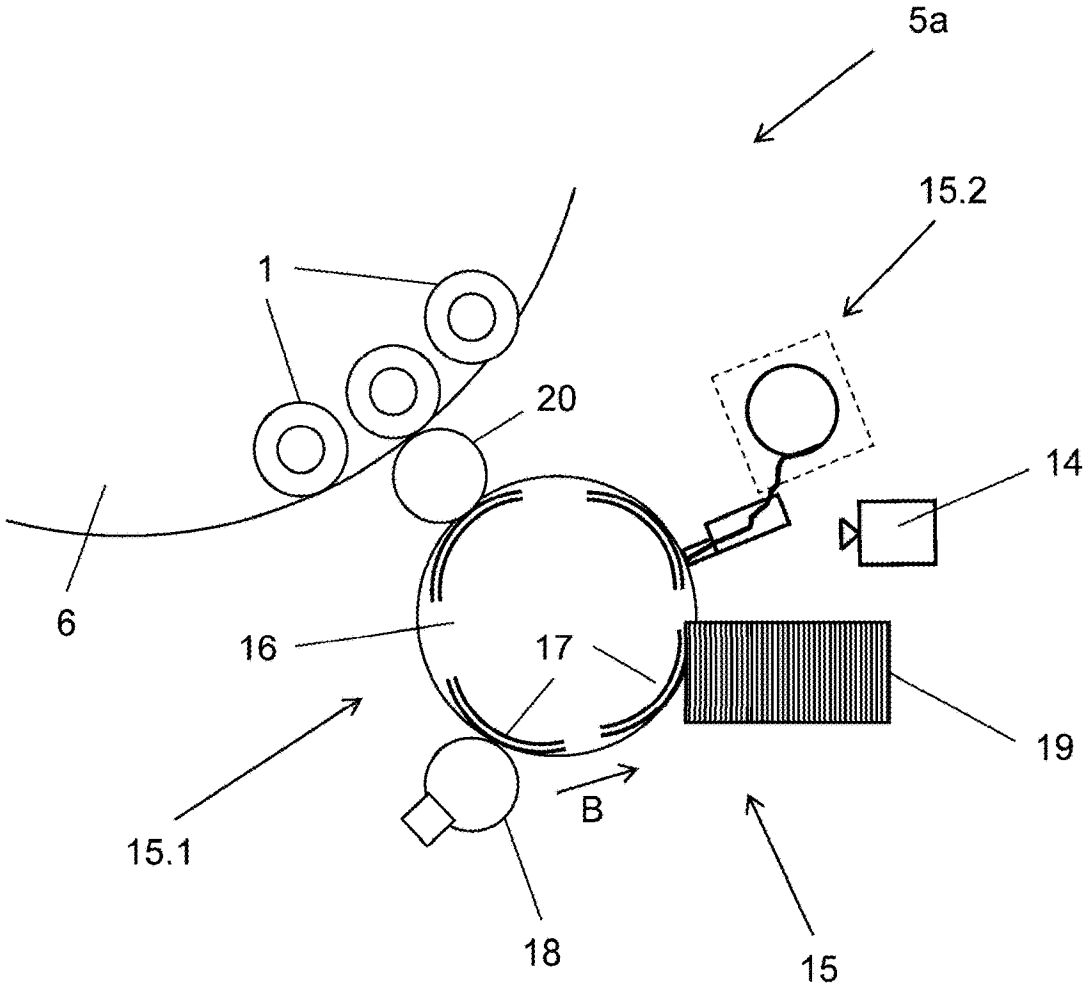
FIG. 8 shows a simplified schematic representation, as viewed from above, of a labeling system in the form of a labeling apparatus for the application onto packaging means of single-sheet labels provided with an additional label element in the form of an additional label.
Figure 10:
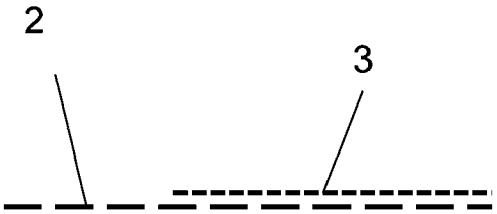
FIGS. 9 and 10 show a single-sheet label, provided with an additional label element, in a side view (FIG. 9) and in a simplified sectional representation (FIG. 10)
Figure 9:
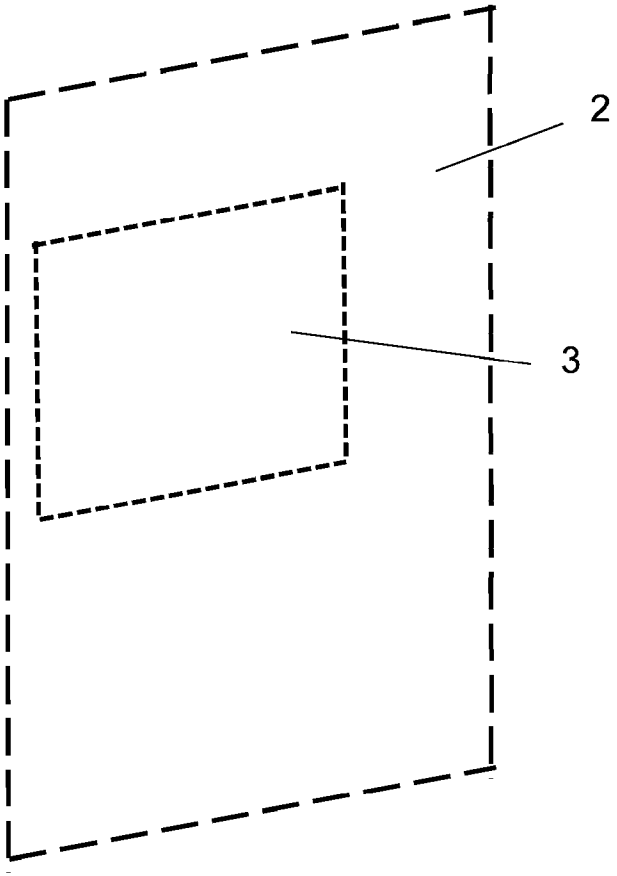

It has been assumed heretofore that for the base labels 2, use is made of a web-form label material drawn from a label store 2.1. The method according to the present application can, however, also be used with base labels 2 which are provided as single-sheet labels. FIG. 8 shows in schematic representation a labeling apparatus 15 suitable for this purpose, which with the labeling machine 5*a* is used instead of the labeling apparatus 11. The labeling apparatus 15 comprises a labeling station 15.1 for processing single-sheet labels. The labeling apparatus 15 also comprises a labeling station 15.2 integrated into the labeling apparatus 15, for the application of the additional label elements 3 onto the base labels 2, as is represented schematically in FIGS. 9 and 10, before these are transferred to the packaging means 1, which are being moved by the rotor 6 past the labeling apparatus 15. A central element of the labeling station 15.1 is a pallet carrier 16, which can be driven such as to circulate (arrow B) about an axis parallel or substantially parallel to the machine axis, with a plurality of controlled pivotable label pallets 17. The label pallets 17 are conveyed by the pallet carrier 16 at least to a gluing station 18 for the application of a cold glue or label glue, and then to a label store 19 for the taking up in each case of the first base label 2, provided there as a single-sheet label. The label pallets 17 are then conveyed by the pallet carrier 16 to the labeling station 15.2 for the application of the additional label element 3 onto the front side of the respective base label 2 held at a label pallet 17. The label pallets 17 are then conveyed by the pallet carrier 16 to a gripping or transfer cylinder 19, for transfer of the respective base label 2, provided with the additional label element 3, to the packaging means 1, being moved past at the labeling apparatus 15. The additional label elements 3 are, for example, in turn self-adhesive label elements, which are provided on a web-form carrier material drawn off from the store 3.1 and conveyed over a dispensing edge. The application of the additional label elements 3 takes place in turn controlled by the sensor system 14, with which striking features of the base labels 2 arranged on the label pallets 17 are detected, such that an exact or substantially exact and precise or substantially precise location and position arrangement of the additional label elements 3 on the base labels 2 is carried out. The base labels 2, held with their rear side on the label pallets 17, are freely accessible on their label front side, such that the application of the label elements 3 is possible, essentially without any problem or with minimal difficulty. Further, the base labels 2 are fixed by cold glue or label glue adequately securely on the respective label pallet 17, and on these are also precisely or substantially precisely aligned, such that the respective label element 3 can be secured in the correct position on the base label 2.

For the sake of simplicity, it has been assumed heretofore that the connection between the base labels 2 and the additional label elements, in one possible exemplification also the label elements 3, is achieved in that these are configured as self-adhesive. It is of course also possible for the labeling apparatus 11 and/or 15, for example at their labeling stations 11.2 or 15.2, respectively, to be provided with means for the application of an adhesive, for example with at least one glue nozzle, in one possible exemplification with at least one glue nozzle for hot glue, with a glue roller, or with a glue punch. By means of the corresponding application of glue or adhesive, the connection then takes place of the additional label elements 3, configured as non-self-adhesive, to the base labels 2, wherein the label elements 3 are provided, for example, also as single-sheet label elements, or from a web or strip-form material by separation. The glue application for the securing of the respective label element 3 to the base label 2, in one possible exemplification, takes place immediately or substantially immediately before the connecting of the label elements 3 to the base labels 2. Moreover, this connecting can also take place by welding, for example by laser welding and/or ultrasonic welding, and, in one possible exemplification, if the base labels 2 comprise at least on their front sides, and the label elements 3 at least on their rear sides, a weldable material, for example a thermoplastic synthetic material, and/or the label elements 3 are provided on their rear sides with an adhesive which melts under the effect of heat.

With the present application, the label elements 3 configured as additional labels are, for example, information carriers, which, for example, by way of their printing, take account of the specifications which are required and/or desired for the purpose of identification in different countries, and specifically in the respective language version. The additional label elements 3, however, are, for example, also additional labels which make reference, for example, to current events, such as sports events, or the entire arrangement formed by the base label 2 and the label element 3 can be adapted to special occurrences and/or events. Moreover, the label elements 3 can also be configured as collective images, collection or discount points, light stars, draw-off images, etc., wherein the adhesive connection between the label elements 3 and the base elements 2 is then arranged in such a way that the detachment of the label elements 3 is possible without any problem.

The present application has been described heretofore by way of exemplary exemplifications. It is understood that modifications and deviations are possible without departing from the general concept underlying the present application. It is possible, for example, by the use of two labeling stations 11.2 or 15.2, to apply onto each base label 2 at least two additional label elements 3 and/or 3*a*.

The present application relates to a method for equipping packaging means 1, in one possible exemplification containers, such that each packaging means is provided with at least one base label 2 and with at least one additional label element 3 provided on the base label.

Figure 11:
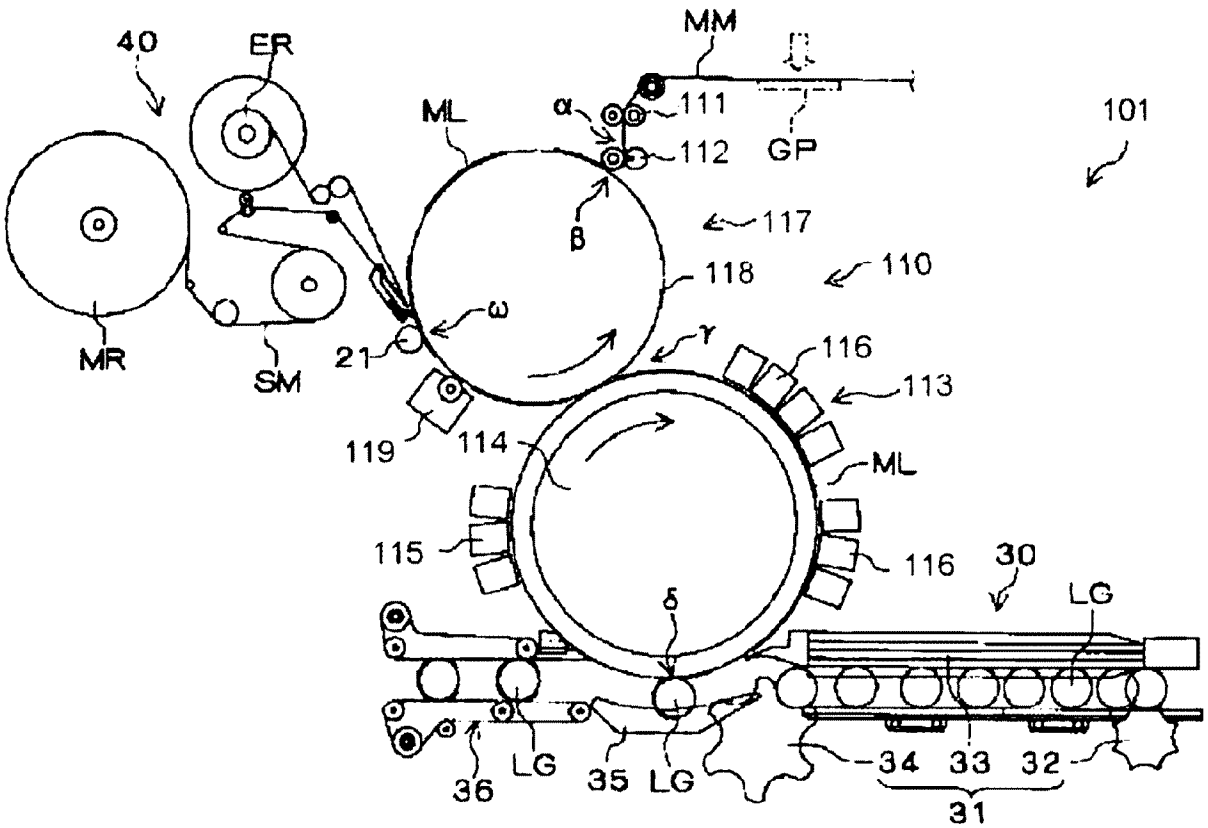
FIG. 11 PRIOR ART
FIG. 11 shows an example of a container labeling machine according to FIG. 1 of prior published Japanese patent application JP 2003-237 748 A1.

FIG. 11 shows an example of a container labeling machine according to FIG. 1 of prior published Japanese patent application JP 2003-237 748 A1. The following six paragraphs contain a machine translation of paras. [0018] to [0024] of the specification of JP 2003-237 748 A1. Some of the reference numerals have been changed in both FIG. 11 and in the following description so as not to conflict with the reference numerals in FIGS. 1-10. It should be understood that the disclosure excerpted from JP 2003-237 748 A1 is provided for exemplary purposes to show one example of components of a container labeling machine, such as guide rollers, cutting devices, vacuum drums, and container conveyor arrangements, that are well known to persons of ordinary skill in the art of container labeling. Such well known components and variations thereof could be used or adapted for use in at least one embodiment of the present application.

As shown in FIG. 11, the label affixing system 101 includes a main labeler 110 for affixing a main label ML to a bottle container B of a liquid commodity LG and a main labeler 110 for passing the liquid commodity LG through a main label affixing position δ, and a sub labeler 40 for affixing the sub label SL to the main label ML before affixing the main label ML to the bottle container B of the liquid commodity LG.

As shown in FIG. 11, the main labeler 110 includes a pair of feed rollers 111 for continuously feeding a long main label forming base material MM wound in a roll shape to a cutting position α. The main label ML is formed by sequentially cutting the main label forming base material MM supplied by the roller 111 at the predetermined cutting pitch at the cutting position α while conveying the main label forming base material MM to the first transfer position β. A label affixing device 113 is used for affixing the main label ML to the outer peripheral surface of the body portion of the bottle container B of the liquid product LG conveyed to the main label affixing position δ. The main label ML is cut from the main label forming base material MM at the first delivery position β and handed over to the label affixing device 113 at the second delivery position γ.

As shown in the figure, the label affixing device 113 sucks and holds the main label ML transferred from the label delivery device 117 at the second delivery position γ on the outer peripheral face so that the back face thereof faces outward. An infrared heater 115 (for example, a near infrared heater using a halogen lamp) is used for preliminarily heating the outer peripheral surface of the affixing drum 114 before sucking and holding the main label ML on the affixing drum 114, and an infrared heater 116 is used for heating the main label ML sucked and held by the affixing drum 114. The main label ML sucked and held on the outer peripheral surface of the affixing drum 114 is rotated by the affixing drum 114 to the main label affixing position δ. At the main label affixing position δ, the main label ML is affixed to the bottle of the liquid product LG conveyed by the product conveying device 30. It should be noted that the main label ML sucked and held by the affixing drum 114 is heated by the infrared heater 116 in the middle of conveyance, and is brought into a state where it can be bonded until reaching the main label affixing position δ.

The label delivering device 117 includes a conveying drum 118 for sucking and holding the main label ML delivered from the cutting conveying device 112 at its outer peripheral surface so that the surface thereof faces outward at the first delivery position β, and includes a printing device 119 for printing predetermined information, such as expiration date and serial number, on the surface of the main label ML sucked and held on the outer circumferential surface. When the conveyance drum 118 rotates on its own axis, the main label ML held by suction is conveyed to the second delivery position γ, and predetermined information is printed on the surface of the main label ML by the printing device 119 during the conveyance.

The commodity transfer device 30 sequentially feeds a plurality of liquid products LG conveyed by a belt conveyor or the like (not shown) to the main label affixing position δ at a predetermined interval via a star wheel 32, a screw conveyor 33, and a star wheel 34, so that the liquid product LG supplied to the main label affixing position δ is brought into contact with the outer circumferential surface of the affixing drum 114 and is sent out while rotating by the rotational force of the affixing drum 114. A guide body 35 is used for guiding the product LG along the outer circumferential surface of the affixing drum 114, and a commodity ejecting section 36 including a belt conveyor is used for carrying out the liquid product LG delivered from the main label affixing position δ. The liquid product LG rotates while contacting the affixing drum 114 at the main label affixing position δ.

The sublabeller 40 separates the long sublabel forming base material SM, in which the individual sublabels SL have been punched in advance, in a state of being affixed to the release paper, on the outer peripheral surface of the conveyance drum 118 constituting the label delivery device 117 intermittently fed in the vicinity of the sub label affixing position ω set between the delivery position β and the printing device 119. In the vicinity of the sub label affixing position ω, the sub-label forming substrate SM is sharply bent around the peel plate at an acute angle. The individual labels ML pass through the sub label pasting position ω while being sucked and held on the outer circumferential surface of the conveying drum 118 while peeling the individual sub labels SL one after another from the release paper of the sub label forming substrate SM. The long sub-label forming base material SM is a regular tack labeler that is formed by laminating a long base roll forming base material SM from a base material roll MR wound in a roll.

A label detection sensor (not shown) for detecting the main label ML is provided on the conveyance path of the main label ML by the conveyance drum 118 in front of the sub-label attachment position ω. From this label detection sensor the sub labeler 40 intermittently feeds the sub label forming substrate SM by a predetermined length. At a point of time after a predetermined time has passed after the sub labeler 40 receives the output label detection signal, the main label ML is at a predetermined position so that the sublabel SL can be stably affixed. Therefore, by properly adjusting the feeding timing of the sub-label forming base material SL by the sub labeler 40 after receiving the label detection signal, the sub label SL can be stuck to an arbitrary position in the longitudinal direction of the main label ML.

One feature or aspect of an exemplification is believed at the time of the filing of this patent application to possibly reside broadly in a method for equipping packaging means 1, in one possible exemplification of containers, in such a way that each packaging means 1 is provided with at least one base label 2 and with at least one additional label element 3, which is applied onto the front side of the base label 2, facing away from the packaging means 1 and therefore visible, wherein the method is carried out with the use of a labeling unit 11.2, which is integrated into a labeling apparatus 11 for the processing of a web or strip-form label material 12, 12*a*, from which the base labels 2 are produced by cutting off, and wherein the method comprises at least the following method steps: providing the base labels 2 in the form of the web or strip-form label material 12, 12*a*, applying the at least one additional label element 3 on the respective base label 2, and the step of subsequent application of the base label 2 provided with the at least one additional label element 3 onto the packaging means 1 which is to be equipped, wherein the base labels 2 are formed by cutting off in each case a part length of the label material, and the application of the respective additional label element 3 to the front side of the respective base label 2, before this is separated from a web or strip-form label material 12, 12*a*.

Another feature or aspect of an exemplification is believed at the time of the filing of this patent application to possibly reside broadly in a method for equipping packaging means 1, in one possible exemplification of containers, in such a way that each packaging means 1 is provided with at least one base label 2, of which the front side faces away from the packaging means 1, and with at least one additional label element 3 provided on the base label 2, the dimensions of which are smaller than the dimensions of the base labels 2, wherein the method is carried out with the use of a labeling unit 15.2, which is integrated into a labeling apparatus 15 for the processing of base labels 2 in the form of single-sheet labels, which are taken from a label store 19 with glued label pallets 17 on a circulating pallet carrier 16, and wherein the method comprises at least the following method steps: Provision of the base labels 2 in the label store 19, connection of the respective base label 2 on the label pallet 17 to at least one additional label element 3, and then removal of the base label 2 provided with the at least one label element 3 from the label pallet 17 and application of the base label 2 provided with the at least one label element 2 onto the packaging means 1 which is to be equipped, wherein next the respective base label 2, with the glued label pallet 17, is taken out of the label store 19, and then the at least one additional label element 3, as a self-adhesive label element, or capable of being welded to the base label 2, for example as a label element capable of being welded by laser or ultrasonics, is applied onto the front side of the base label 2 held at the label pallet 17.

Yet another feature or aspect of an exemplification is believed at the time of the filing of this patent application to possibly reside broadly in the method, wherein, as additional label elements 3, 3*a*, self-adhesive label elements, for example label elements 3*a* self-adhesive on both sides, are used, or label elements which are connected by means of an adhesive or glue application to the respective base label 2.

Still another feature or aspect of an exemplification is believed at the time of the filing of this patent application to possibly reside broadly in the method, wherein the glue application takes place immediately or substantially immediately before or during this connection.

A further feature or aspect of an exemplification is believed at the time of the filing of this patent application to possibly reside broadly in the method, wherein the connection of the label elements 3, 3*a* to the base labels 2 is effected by welding, for example by laser welding or ultrasonic welding.

Another feature or aspect of an exemplification is believed at the time of the filing of this patent application to possibly reside broadly in the method, wherein, as additional label elements 3, 3*a*, single-sheet label elements are used, or label elements separated or detached from a web or strip-form material.

Yet another feature or aspect of an exemplification is believed at the time of the filing of this patent application to possibly reside broadly in the method, wherein application of the at least one additional label element 3, 3*a* takes place controlled by a sensor system 14, which monitors the location and/or position of the base labels 2 or of the label material 12, 12*a*.

Still another feature or aspect of an exemplification is believed at the time of the filing of this patent application to possibly reside broadly in a labeling system, for example labeling apparatus, for the equipping of packaging means 1, in one possible exemplification of containers, with base labels 2 and with additional label elements 3, 3*a* provided on said base labels, which are applied onto the front side of the base label 2, facing away from the packaging means 1 and therefore visible, with a first labeling unit 11.1 for the application of the base labels 2, provided by separation from a strip-form label material, onto the packaging means 1, wherein the labeling system 11 additionally comprises at least one second labeling unit 11.2, with which the additional label elements 3, 3*a* are applied inside the labeling system 2 onto the base labels 2, wherein in the first labeling unit 11.1, the base labels 2 are in each case produced by cutting off a part length of the label material, and that the further labeling unit 11.2 is configured in such a way that the application of the additional label element 3, 3*a* takes place on the front side of the respective base label 2, before this is cut off from a web or strip-form label material 12, 12*a*.

A further feature or aspect of an exemplification is believed at the time of the filing of this patent application to possibly reside broadly in a labeling system, for example labeling apparatus, for equipping packaging means 1, in one possible exemplification of containers, with base labels 2, of which the front side in each case faces away from the packaging means 1, and with at least one additional label element 3 provided on each base label 2, the dimensions of which are smaller than the dimensions of the base labels 2, with a first label unit 15.1 for the processing of base labels 2 in the form of single-sheet labels, which, with glued label pallets 17 on a circulating pallet carrier 16 of the labeling unit 15.1, are taken from a label store 19, wherein the labeling system 15 comprises at least one second labeling unit 15.2 for the processing of additional label elements 3, of which the dimensions are smaller than the dimensions of the base labels 2, and wherein the at least one second labeling unit 15.2 is integrated into the first labeling unit 15.1 in such a way that the base labels 2 are connected to at least one additional label element 3, and then, with the at least one additional label element 3, 3*a*, are taken from the label pallet 17, and transferred, with the at least one additional label element 3, 3*a*, onto the packaging means 1 which is to be equipped, wherein the second labeling unit 15.2 is configured and integrated into the first labeling unit 15.1 in such a way that, first, the respective base label 2 with the glued label pallet 17 is taken from the label store 19, and then the at least one additional smaller label element 3 is applied onto the front side of the base label 2 held on the label pallet 17, and that a sensor system 14 is provided for the recognition of the present location and/or position of the respective base label 2, and to control the application with precise or substantially precise location and/or position of the at least one additional label element 3, 3*a* on the base label 2.

Another feature or aspect of an exemplification is believed at the time of the filing of this patent application to possibly reside broadly in the labeling system, comprising a sensor system 14 for the detection of the present location and/or position of the respective base label 2 and or to control the application, with precise or substantially precise location and/or position, of the at least one additional label element 3, 3*a* on the base label 2.

Yet another feature or aspect of an exemplification is believed at the time of the filing of this patent application to possibly reside broadly in the labeling system, comprising means for the application of an adhesive for the connection of the respective additional labeling element 3, 3*a* to the base label 2, wherein these means are comprised, for example, of at least one glue nozzle, for example of a glue nozzle for hot glue, a glue roller, or a glue punch.

A further feature or aspect of an exemplification is believed at the time of the filing of this patent application to possibly reside broadly in a device or labeling machine for equipping packaging means 1, in one possible exemplification of containers, with base labels 2, and additional label elements 3, 3*a* provided on these, with at least one labeling system, wherein the labeling system is configured in accordance with the present application.

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or useable in any one or more exemplifications of the application.

The sentence immediately above relates to patents, patent applications, patent publications, and other documents either incorporated by reference or not incorporated by reference.

The following patents, patent documents, patent publications, and other documents are hereby incorporated by reference as if set forth in their entirety herein except for the exceptions indicated herein: JP 2006/027641 A, having the English translation of the Japanese title "LABEL AFFIXING METHOD AND LABEL", published on Feb. 2, 2006; JP 2 597 330 B2, having the English translation of the Japanese title "LABELLER", published on Apr. 2, 2007; BR 302 257 B1, having the Portuguese title "Aperfeiçoamento em conjunto aplicador de artigos auto-adesivos", published on Sep. 4, 2012; US 2006/0070700 A1, having the title "System for automated label activation and application", published on April 6, 2006; ES 2 020 709 A6, having the English translation of the Spanish title "Improvements in sausage labelling machines," published on Sep. 1, 1991; DE 20 2010 004 060 U1, having the German title "Vorrichtung zur Herstellung von bedruckten Verbundetiketten", published on Jun. 17, 2010; JP 2009-062 088 A, having the English translation of the Japanese title "SHEET PASTING APPARATUS, AND PASTING METHOD", published on Mar. 26, 2009; DE 37 15 920 A1, having the English translation of the German title "LABELLING MACHINE", published on Nov. 24, 1988; US 2005/0219051 A1, having the title "RFID label application system", published on Oct. 6, 2005; JP 2003-237 748 A1, having the English translation of the Japanese title "LABEL AFFIXING SYSTEM", published on Aug. 27, 2003; and DE 31 10 187 C2, having the English translation of the German title "Labelling station of a labelling machine for articles, such as bottles, and process for the labelling of articles, such as bottles, with a plurality of labels", published on Apr. 18, 1985.

All of the patents, patent applications, patent publications, and other documents, except for the exceptions indicated herein, which were cited in the German Office Action dated Jun. 27, 2014, and/or cited elsewhere, as well as the German Office Action document itself, are hereby incorporated by reference as if set forth in their entirety herein except for the exceptions indicated herein, as follows: JP 2006/027641 A, having the English translation of the Japanese title "LABEL AFFIXING METHOD AND LABEL", published on Feb. 2, 2006; JP 2 597 330 B2, having the English translation of the Japanese title "LABELLER", published on Apr. 2, 2007; BR 302 257 B1, having the Portugese title "Aperfeiçoamento em conjunto aplicador de artigos auto-adesivos", published on Sep. 4, 2012; US 2006/0070700 A1, having the title "System for automated label activation and application", published on Apr. 6, 2006; DE 10 2010 019 855 A1, having the English translation of the German title "Method for labeling stackable reusable transport and storage container utilized for transportation and storage of e.g. meat, involves securing sheet at discrete points of film by heat sealing at wall of container, so that sheet is removable", published on Nov. 10, 2011; ES 2 020 709 A6, having the English translation of the Spanish title "Improvements in sausage labelling machines," published on Sep. 1, 1991; DE 20 2010 004 060 U1, having the German title "Vorrichtung zur Herstellung von bedruckten Verbundetiketten", published on Jun. 17, 2010; US 2005/0219051 A1, having the title "RFID label application system", published on Oct. 6, 2005; JP 2003-237 748 A1, having the English translation of the Japanese title "LABEL AFFIXING SYSTEM", published on Aug. 27, 2003; JP 2009-062 088 A, having the English translation of the Japanese title "SHEET PASTING APPARATUS, AND PASTING METHOD", published on Mar. 26, 2009; DE 2 063 483 A, having the German title "Verfahren and Vorrichtung zum Herstellen von selbstklebenden Doppeletiketten", published on Jul. 6, 1972; DE 37 15 920 A1, having the English translation of the German title "LABELLING MACHINE", published on Nov. 24, 1988; DE 31 10 187 C2, having the English translation of the German title "Labelling station of a labelling machine for articles, such as bottles, and process for the labelling of articles, such as bottles, with a plurality of labels", published on Apr. 18, 1985; and DE 41 02 194 A1, having the English translation of the German title "Label prodn. without stamping out—by feeding at regular intervals rim-coated substrates and coverings plus intermediate inserts onto conveyor belts, and bonding them together", published on Jul. 30, 1992.

All of the patents, patent applications, patent publications, and other documents, except for the exceptions indicated herein, which were cited in the International Search Report dated May 27, 2015, and/or cited elsewhere, as well as the International Search Report document itself, are hereby incorporated by reference as if set forth in their entirety herein except for the exceptions indicated herein, as follows: JP 2003-237 748 A1, having the English translation of the Japanese title "LABEL AFFIXING SYSTEM", published on Aug. 27, 2003; JP 2003 211566 A, having the English translation of the Japanese title "APPARATUS FOR MANUFACTURING RADIO RECOGNITION DATA CARRIER LABEL", published on Jul. 29, 2003; US 2006/267776, having the title "RFID-tag fabricating apparatus and cartridge", published on November 30, 2006; DE 31 10 187 C2, having the English translation of the German title "Labelling station of a labelling machine for articles, such as bottles, and process for the labelling of articles, such as bottles, with a plurality of labels", published on Apr. 18, 1985; and WO 01/81179, having the English translation of the German title "DEVICE AND METHOD FOR APPLYING A SECURING ELEMENT TO A LABEL", published on Nov. 1, 2001.

The corresponding foreign and international patent publication applications, namely, Federal Republic of Germany Patent Application No. 10 2014 105 104.1, filed on Apr. 10, 2014, having inventors Michael ZWILLING, Gunnar CLAUSEN, Klaus KRÄMER, Nicholas Alexander HABERS, and Andreas ULLRICH and DE-OS 10 2014 105 104.1 and DE-PS 10 2014 105 104.1, and International Application No. PCT/EP2015/055015, filed on Mar. 11, 2015, having WIPO Publication No. WO 2015/154932 and inventors Michael ZWILLING, Gunnar CLAUSEN, Klaus KRÄMER, Nicholas Alexander HABERS, and Andreas ULLRICH, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications, patent publications, and other documents, except for the exceptions indicated herein, are hereby incorporated by reference as if set forth in their entirety herein except for the exceptions indicated herein.

The purpose of incorporating the corresponding foreign equivalent patent application(s), that is, PCT/EP2015/055015 and German Patent Application 10 2014 105 104.1, is solely for the purposes of providing a basis of correction of any wording in the pages of the present application, which may have been mistranslated or misinterpreted by the translator, and to provide additional information relating to technical features of one or more exemplifications, which information may not be completely disclosed in the wording in the pages of this application.

Statements made in the original foreign patent applications PCT/EP2015/055015 and DE 10 2014 105 104.1 from which this patent application claims priority which do not have to do with the correction of the translation in this patent application are not to be included in this patent application in the incorporation by reference.

Any statements about admissions of prior art in the original foreign patent applications PCT/EP2015/055015 and DE 10 2014 105 104.1 are not to be included in this patent application in the incorporation by reference, since the laws relating to prior art in non-U.S. Patent Offices and courts may be substantially different from the Patent Laws of the United States.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

AT LEAST PARTIAL NOMENCLATURE

1 Packaging means
2 Base label
2.1 Label store
3,3*a* Additional label element
3.1 Label store
4 Design feature
5, 5*a* Labeling machine
6 Rotor
6.1 Treatment position
7 Packaging means inlet
8 Packaging means outlet
9,10 Labeling apparatus
11 Labeling apparatus
11.1, 11.2 Labeling unit or station
12, 12*a* Label material
13 Carrier path
14 Sensor system
15 Labeling apparatus
15.1, 15.2 Labeling unit or station
16 Pallet carrier
17 Label pallet
18 Gluing device
19 Label store
20 Transfer cylinder
A Direction of rotation of rotor 6
B Direction of rotation of pallet carrier 16
PA Packaging means axis

What is claimed is:

1. Method for equipping packaging, in particular of containers, in such a way that each packaging is provided with at least one base label and with at least one additional label element, which is applied onto the front side of the base label, facing away from the packaging and therefore visible, > wherein the method is carried out with the use of a labeling unit for the processing of the web or strip-form label material, said labeling unit comprising: a supply of web or strip-form label material, a first labeling station comprising feed rollers to feed the web or strip-form label material, a supply of the at least one additional label element, a second labeling station to feed the at least one additional label element, and a cutting device to cut the at least one base label from the web or strip-form label material, and wherein the method comprises at least the following method steps:

providing the base labels in the form of the web or strip-form label material, applying the at least one additional label element on the respective base label, and the step of subsequent application of the base label provided with the at least one additional label element onto the packaging which is to be equipped, wherein the base labels are formed by cutting off in each case a part length of the label material, and the application of the respective additional label element to the front side of the respective base label, before this is separated from a web or strip-form label material, and wherein the connection of the label elements to the base labels is effected by welding, laser welding or ultrasonic welding.

2. Method according to claim 1, wherein, as additional label elements, self-adhesive label elements or label elements self-adhesive on both sides, are used, or label elements which are connected by means of an adhesive or glue application to the respective base label.

3. Method according to claim 2, wherein the glue application takes place immediately before or during this connection.

4. Method according to claim 3, wherein, as additional label elements, single-sheet label elements are used, or label elements separated or detached from a web or strip-form material.

5. Method according to claim 4, wherein application of the at least one additional label element takes place controlled by a sensor system, which monitors the location and/or position of the base labels or of the label material.

6. Method for equipping packaging, in particular of containers, in such a way that each packaging is provided with at least one base label and with at least one additional label element, which is applied onto the front side of the base label, facing away from the packaging and therefore visible, wherein the method is carried out with the use of a labeling unit for the processing of a web or strip-form label material, said labeling unit comprising: a supply of web or strip-form label material, a first labeling station comprising feed rollers to feed the web or strip-form label material, a supply of the at least one additional label element, a second labeling station to feed the at least one additional label element, and a cutting device to cut the at least one base label from the web or strip-form label material, and wherein the method comprises at least the following method steps:

providing the base labels in the form of the web or strip-form label material, applying the at least one additional label element on the respective base label, and the step of subsequent application of the base label provided with the at least one additional label element onto the packaging which is to be equipped, wherein the base labels are formed by cutting off in each case a part length of the label material, and the application of the respective additional label element to the front side of the respective base label, before this is separated from a web or strip-form label material, and wherein, as additional label elements, single-sheet label elements are used, or label elements separated or detached from a web or strip-form material.

7. Method according to claim 6, wherein, as additional label elements, self-adhesive label elements or label elements self-adhesive on both sides, are used, or label elements which are connected by means of an adhesive or glue application to the respective base label.

8. Method according to claim 7, wherein the glue application takes place immediately before or during this connection.

9. Method according to claim 8, wherein, as additional label elements, single-sheet label elements are used, or label elements separated or detached from a web or strip-form material.

10. Method according to claim 9, wherein application of the at least one additional label element takes place controlled by a sensor system, which monitors the location and/or position of the base labels or of the label material.

* * * * *